United States Patent [19]
Oschell et al.
[11] 4,134,727
[45] Jan. 16, 1979

[54] AQUEOUS SOLUTION OF SODIUM METASILICATE AND N-AMINOETHYL ETHANOLAMINE AS A COLD-END ADDITIVE

[75] Inventors: Francis J. Oschell, Stanhope; Bruce L. Libutti, Pompton Plains, both of N.J.

[73] Assignee: Betz Laboratories, Inc., Trevose, Pa.

[21] Appl. No.: 832,328

[22] Filed: Sep. 12, 1977

Related U.S. Application Data

[63] Continuation-in-part of Ser. No. 713,726, Aug. 12, 1976, abandoned.

[51] Int. Cl.[2] ..... C23F 11/00; C23F 11/02

[52] U.S. Cl. ..... 422/9; 110/343; 110/345; 252/389 R; 423/242; 423/243; 423/244

[58] Field of Search ..... 21/2.5 B; 423/242, 243, 423/244; 110/1 J, 1 K, 343, 345; 252/389 R, 392

[56] References Cited

U.S. PATENT DOCUMENTS

| | | | |
|---|---|---|---|
| 2,106,446 | 1/1938 | Baehr et al. | 423/243 X |
| 2,155,853 | 4/1939 | Anthony | 423/243 X |
| 2,972,861 | 2/1961 | Davies | 21/2.5 B UX |
| 3,547,583 | 12/1970 | Wilson | 423/242 |
| 3,709,977 | 1/1973 | Villiers-Fisher | 423/244 |
| 3,809,745 | 5/1974 | Wilson | 423/244 |
| 3,856,921 | 12/1974 | Shrier et al. | 423/243 X |
| 3,873,673 | 3/1975 | Teague et al. | 423/243 |
| 3,886,261 | 5/1975 | Libutti | 423/244 |
| 3,904,735 | 9/1975 | Atwood et al. | 423/243 |
| 3,932,588 | 1/1976 | Libutti et al. | 423/244 |
| 3,961,018 | 6/1976 | Williamson | 423/243 X |
| 3,962,404 | 6/1976 | Grammarco et al. | 423/243 X |

FOREIGN PATENT DOCUMENTS

| | | | |
|---|---|---|---|
| 872984 | 7/1961 | United Kingdom | 423/244 |
| 1305750 | 2/1973 | United Kingdom | 423/244 |

*Primary Examiner*—Barry S. Richman
*Attorney, Agent, or Firm*—Alexander D. Ricci; Steven H. Markowitz

[57] ABSTRACT

A method of reducing the amount of sulfur trioxide condensation on, and therefore the amount of sulfuric acid corrosion of, metal parts at the cold-end of a combustion system in contact with combustion gases derived from the combustion of sulfur-containing fuel, said method comprising adding to the combustion gases an effective amount for the purpose of an aqueous solution of sodium metasilicate and an alkanolamine, particularly N-aminoethyl ethanolamine.

14 Claims, No Drawings

AQUEOUS SOLUTION OF SODIUM METASILICATE AND N-AMINOETHYL ETHANOLAMINE AS A COLD-END ADDITIVE

This application is a continuation-in-part application of Ser. No. 713,726 filed Aug. 12, 1976, now abandoned.

DISCLOSURE OF THE INVENTION

As is well-known to boiler operators, sulfur-containing fuels present problems not only from a pollutional point of view, i.e., acid smut, but also with respect to the life and operability of metallic equipment and parts which are in contact with the flue gases containing the sulfur by-products of combustion.

Upon combustion, the sulfur in the fuel is converted to sulfur dioxide and sulfur trioxide. When sulfur trioxide reaches its dew temperature, it reacts with moisture in the flue gas to produce the very corrosive sulfuric acid. The gases themselves are troublesome as air pollutants, while the acid formed is damaging from corrosion aspects.

As can be appreciated, the greater the sulfur content of the fuel, the more the effects are harmful. This is particularly the case in industrial and utility operations where low grade oils are used for combustion purposes.

Although many additives have been utilized for the purpose of conditioning flue gases, few additives have found overall success. The reason for the relatively little success in this area is felt to be the peculiarities found in the different combustion systems and boiler designs. The gas dynamics and the loads produced, sometimes make chemical treatments for the most part impractical, therefore, requiring a combination of mechanical and chemical treatment.

It was to this problem that the present inventors addressed themselves, i.e., the problem of reducing acid smut and acid corrosion of metal parts utilizing a minimum of mechanical and chemical treatment.

The basic area to which the present invention is directed is often referred to in the industry as the "cold-end" of a boiler operation. This area is generalized as being the path in the boiler system that the combustion gases follow after the gases have, in fact, performed their service of heating water, producing steam and/or superheating steam.

In the larger boiler systems, the last stages through which the hot combustion gases flow include the economizer, the air heater, the collection equipment or the electrostatic precipitator, and then the stack through which the gases are discharged.

The present invention is drawn to the present inventors' discovery of a cold-end additive composition comprising an aqueous solution of sodium metasilicate and an alkanolamine. Any reference to an alkanolamine is intended to include mixtures of alkanolamines.

It was determined that if the inventive composition, in liquid droplet form, is fed to the moving combustion gases upstream of the cold-end surfaces to be treated and, preferably, at a point where the gases are undergoing turbulence, the composition will travel along with the gases and deposit on the downstream cold-end surfaces. The additive composition travels along with the combustion gases as fine solids, vapor, and/or liquid droplets and deposits on the downstream cold-end surfaces. The deposition of the additive composition on the cold-end surfaces results from the transsition of the gas flow from a zone of relative turbulence to a zone where the turbulence subsides and/or from the lowering of the temperature of combustion gases below the dew point of any vaporous additive. In addition, additive may impact on surfaces which interrupt or constrict the gas flow.

In three articles, a first entitled "The Selection and Use of Additives in Oil-fired Boilers", by W. D. Jarvis and appearing in the November, 1958 issue of the *Journal of the Institute of Fuel;* a second entitled "The Use of Ammonia for Reducing Air-heater Corrosion at Bankside Generating Station, C.E.G.B.", by J. T. S. Gundry, B. Lees, L. K. Rendle, and E. J. Wicks and appearing in the October, 1964 issue of *Combustion;* and a third entitled "The Use of Heterocyclic Tertiary Amines for the Control of Corrosion Caused by Flue Gases", by E. Brett Davies and B. J. Alexander and appearing in the April, 1960 issue of the *Journal of the Institute of Fuel;* the use of heterocyclic tertiary amines, obtained from the distillation of crude coal tar, as boiler cold-end additives is disclosed. Besides disclosing that heterocyclic tertiary amines inhibit boiler cold-end corrosion, the articles also point out that the use of these chemicals causes black carbonaceous deposits on cold-end surfaces, which deposits can become pasty and have a pronounced smell, apparently due to their derivation from coal tar. The present inventors discovered alkanolamines as cold-end additives. It was determined that these compounds produced no black deposits having a pronounced smell.

The liquid additive is fed as an aqueous solution. There are numerous methods available to the artisan for feeding the additive in droplet form, which methods are deemed well within the skill of the art. For example, liquid atomizer nozzles could be utilized for the purpose. The present inventors obtained satisfactory results using a sonic feed nozzle to produce a mist of the additive solution even though additive deposits formed on the nozzle. The use of a pressure atomizing nozzle system with in-line dilution and water purging should resolve any problems related to the formation of deposits on the nozzle. The size range of the liquid droplets is preferably small enough to ensure that the additive which does not evaporate but, instead, is present in the combustion gases in liquid droplet form or particulate form, will be carried along with the combustion gases so as to be deposited on the surfaces to be treated. Based upon the present inventors' prior experience in this area, the size of the droplets could be as large as about 360 microns with the preferred maximum size being about 260 microns.

The amount of additive used will of course depend on the nature and severity of the problem to be treated, and is a function of the sulfur content of the fuel, and more specifically, the $SO_3$ (sulfur trioxide) produced upon combustion. On an actives basis, as little as about 0.1 pound of the alkanolamine alone per pound of $SO_3$ generated could be used. The preferred minimum is about 0.25 pound of alkanolamine per pound of $SO_3$. Based on economic considerations, the amount of active alkanolamine alone could be as high as about 1.0 pound per pound of $SO_3$ generated, while about 0.33 pound per pound of $SO_3$ generated is the preferred maximum. On an actives basis, as little as about 0.15 pound of sodium metasilicate per pound of $SO_3$ could be used. The preferred minimum is about 0.25 pound of sodium metasilicate per pound of $SO_3$. Based on economic considerations, the amount of active sodium metasilicate alone could be as high as about 1.0 pound per pound of $SO_3$, while about 0.75 pound of sodium metasilicate per pound of $SO_3$ represents the preferred maximum. Particularly good results were observed at 0.45 pound of sodium metasilicate per pound of $SO_3$. Accordingly, the inventive composition is considered to comprise from about 0.15 to about 0.9 pound of sodium metasilicate per pound of $SO_3$ generated and from about 0.1 to about 0.85 pound of alkanolamine per pound of $SO_3$ generated, with the proviso that the total treatment level does not exceed 1.0 pound of the inventive composition per pound of $SO_3$. The preferred relative proportions are from about 0.25 to about 0.75 pound of sodium metasilicate per pound of $SO_3$ generated and from 0.25 to about 0.33 pound of alkanolamine per pound of $SO_3$ generated, with the proviso that the total treatment does not exceed 1.0 pound of the inventive composition per pound of $SO_3$. The one pound maximum treatment level is also based on economic considerations.

The temperature of the combustion gases at the time of addition is from about 250° F. to about 675° F., preferably from about 350° F. to about 650° F. Since, in most instances, the temperature of the combustion gases will be at least 405° F. at the point of addition, that is the most preferred lower limit of the temperature range.

In order to assess the efficacy of the inventive materials individually, various tests were conducted on industrial boiler systems which were fired by fuel oil containing about 2.2 percent sulfur. The abilities of the inventive additive to coat surfaces and to reduce acid deposition, corrosion and fouling were evaluated. Acid deposition rates at various surface temperatures were determined by titrating washings from a probe similar to a standard air-cooled CERL probe. The nature of the surface coating was determined by visual inspection of the probe. The washings were also analyzed for total iron and total solids content to obtain indications of corrosion rates and fouling tendencies, respectively. Using a Land meter, the rate of acid build-up (RBU) was determined.

The alkanolamine tested was commercially available N-aminoethyl ethanolamine (Naeea) which was obtained from Union Carbide. The additive was mixed with water and a commercially available sodium salt of EDTA (as a stabilizer) to form an aqueous solution comprising 49.9% water, 50% Naeea and 0.1% stabilizer. The additive solution was fed to the combustion gases in a duct at the cold-end of the systems, using an atomizer nozzle located in the duct.

The sodium metasilicate tested was an aqueous solution containing 25% active sodium metasilicate. While the anhydrous form of sodium metasilicate was used, the hydrated form could also be used. The additive, in liquid form, was also fed to the combustion gases in a duct at the cold-end of the systems, using an atomizer nozzle located in the duct.

In a first series of tests, which will hereinafter be referred to as the preliminary tests, the combustion gases contained about 18 parts of sulfur trioxide per million parts of combustion gases on a volume basis.

In a second series of tests, which will hereinafter be referred to as the confirming tests, the combustion gases contained about 55 parts of sulfur trioxide per million parts of combustion gases on a volume basis. In the confirming tests the sodium metasilicate was further diluted with one part water by volume.

EXAMPLE 1

As already noted, the effects of the sodium metasilicate alone on acid deposition rates at various surface temperatures were determined by titrating washings from a probe similar to a standard British Central Electricity Research Laboratories (CERL) acid deposition probe. The construction and operation of this probe are well known in the art as evidenced by an article entitled "An Air-cooled Probe for Measuring Acid Deposition in Boiler Flue Gases" by P. A. Alexander, R. S. Fielder, P. J. Jackson, and E. Raask, page 31, Volume 38, *Journal of the Institute of Fuel;* which is hereby incorporated by reference to indicate the state of the art. Washings from the probe were titrated for sulfuric acid with sodium hydroxide.

The results of these tests are reported in Tables 1A and 1B below in terms of acid deposition rate expressed as milliliters of 0.01N NaOH needed to titrate one fourth the amount of acid which deposited on 18.8 square inches ($in^2$) to the phenolphthalein end point. The feedrates reported are expressed as pounds of active additive per hour, and the steam loads reported are also expressed as pounds per hour. The % $O_2$ reported is the oxygen content of the combustion gases on a % volume basis. Table 1A contains the results of the preliminary tests, and Table 1B contains the results of the confirming tests. In the preliminary tests, the acid deposition rates at 220° F. were determined; while in the confirming tests, the determinations were for acid deposition at 230° F. and 250° F. In the preliminary tests, the probe was exposed to the combustion gases for thirty minutes; while in the confirming tests, the probe was exposed for the time periods indicated.

TABLE 1A

| Additive | Feedrate (pph) | Steam Load (pph × $10^3$) | % $O_2$ | Acid Deposition 220° F |
|---|---|---|---|---|
| None | — | 75–76 | 2.3–3.0 | 8.5 |
| None | — | 90 | 2.7 | 10.0 |
| $Na_2SiO_3$ | 4.1 | 90 | 2.7 | 0 |
| $Na_2SiO_3$ | 4.1 | 90 | 2.7 | 0 |

TABLE 1B

| Additive | Exposure (hours) | Feedrate (pph) | Steam Load (pph × $10^3$) | % $O_2$ | Acid Deposition 230° F | Acid Deposition 250° F |
|---|---|---|---|---|---|---|
| None | 0.5 | — | 100 | 2.5–3.0 | 38 | 28 |
| None | 0.5 | — | 100 | 2.5–3.0 | 38 | 28 |
| None | 0.5 | — | 114 | 2.5–3.0 | 46 | 32 |
| None | 3.0 | — | 104 | 2.5–3.0 | 108 | 72 |
| $Na_2SiO_3$ | 0.5 | 3.8 | 100 | 2.5–3.0 | 15 | 12 |
| $Na_2SiO_3$ | 0.5 | 3.8 | 114 | 2.5–3.0 | 25 | 20 |
| $Na_2SiO_3$ | 3.0 | 3.8 | 104 | 2.5–3.0 | 52 | 42 |

From the results reported in Tables 1A and 1B it can be seen that the rate of acid deposition on the probe was reduced significantly when the sodium metasilicate was added to the combustion gases. This reduction in the acid deposition rate reflects the efficacy of the additive as a neutralizing agent.

EXAMPLE 2

In a second series of tests, the efficacy of the sodium metasilicate with respect to lowering the apparent acid dew point in the cold-end of the boiler system was evaluated. Using a commercially available Land dew point meter, the condensation of a conducting film of sulfuric acid on a controlled temperature probe tip was detected by the onset of the flow of electric current between electrodes embedded in the tip. This permitted the determination of the apparent acid dew point, and comparative rates of acid build-up directly on probe surfaces were obtainable from the rate of increase in current with time at any tip temperature. The results of these tests are reported in Tables 2A and 2B below. The feedrate of active additive and the boiler steam load are both expressed as pounds per hour, the apparent dew points are expressed as degrees Farenheit (° F.) and the rate of acid build-up (RBU) are expressed as microamperes per minute ($\mu$amp $min^{-1}$). Table 2A contains the results of the preliminary tests, and Table 2B contains the results of the confirming tests. The rate of acid build-up was determined only for a portion of the tests as indicated in the Tables and was determined at a probe surface temperature of 230° F. for both tests. A reported RBU range indicates that the RBU changed during the test. Apparent dew point is defined as that temperature at which an acid film contacts a surface, at the cold-end in this instance.

TABLE 2A

| Additive | Feedrate (pph) | Steam Load (pph × $10^3$) | % $O_2$ | Dew Pont (° F) | RBU |
|---|---|---|---|---|---|
| None | — | 88 | 2.6 | 279 | 120 |
| $Na_2SiO_3$ | 4.1 | 88 | 2.6 | 262 | 70 |

TABLE 2B

| Additive | Feed-rate (pph) | Steam Load (pph × $10^3$) | % $O_2$ | Dew Point (° F) | RBU |
|---|---|---|---|---|---|
| None | — | 114 | 2.5–3.0 | 293 | 400 |
| None | — | 116 | 2.5–3.0 | 300 | 420–560 |
| None | — | 124 | 2.5–3.0 | 296 | — |
| None | — | 124 | 2.5–3.0 | 300 | — |
| None | — | 125 | 2.5–3.0 | 296 | 280–500 |
| $Na_2SiO_3$ | 3.8 | 114 | 2.5–3.0 | 165 | 0 |
| $Na_2SiO_3$ | 3.8 | 124 | 2.5–3.0 | 160 | 0 |

From Tables 2A and 2B it can be seen that the sodium metasilicate demonstrated efficacy both with respect to lowering the apparent acid dew point in the cold-end and with respect to decreasing the rate of acid build-up directly on surfaces in the cold-end. By lowering the apparent acid dew point, the chance of the acid condensing in the cold-end of the boiler system at a given temperature is decreased. Furthermore, by lowering the apparent acid dew point in the cold-end, the combustion gas temperature can be lowered, resulting in an increase in boiler efficiency without a corresponding increase in corrosion of surfaces at the cold-end.

EXAMPLE 3

Using a portion of the washings obtained from the CERL probe described in Example 1 above, the efficacy of the sodium metasilicate with respect to protecting cold-end surfaces against corrosion was evaluated. Since the iron (Fe) content of the washings indicated the amount of corrosion of the test surfaces exposed to combustion gases, comparisons of the iron content of the washings provided a method of evaluating the efficacy of the sodium metasilicate. The results of these comparative tests are reported below in Tables 3A and 3B, with Table 3A containing the results of the preliminary tests and Table 3B containing the results of the confirming tests. In the preliminary tests, the probe was exposed to the combustion gases for 0.5 hour, and in the confirming tests the probe was exposed for the periods as indicated in Table 3B. The steam loads and active additive are expressed as pounds per hour (pph), the oxygen content of the combustion gases as percent oxygen (% $O_2$) by volume, and the iron content as parts of iron per million parts of washing liquid at the probe temperatures indicated.

TABLE 3A

| Additive | Feedrate (pph) | Steam Load (pph × $10^3$) | % $O_2$ | Iron (ppm) 230° F | Iron (ppm) 250° F |
|---|---|---|---|---|---|
| None | — | 90 | 2.7 | 16 | 6 |
| $Na_2SiO_3$ | 4.1 | 90 | 2.7 | 8 | 4 |
| $Na_2SiO_3$ | 4.1 | 90 | 2.7 | 8 | 5 |

TABLE 3B

| Additive | Ex-posure (hours) | Feed-rate (pph) | Steam Load (pph × $10^3$) | % $O_2$ | Iron (ppm) 230° F | Iron (ppm) 250° F |
|---|---|---|---|---|---|---|
| None | 0.5 | — | 100 | 2.5–3.0 | 70 | 55 |
| None | 0.5 | — | 100 | 2.5–3.0 | 90 | 60 |
| None | 0.5 | — | 100 | 2.5 | 60 | 25 |
| None | 3.0 | — | 104 | 2.5–3.0 | 130 | 70 |
| None | 6.0 | — | 104 | 2.6–3.1 | 400 | 200 |
| $Na_2SiO_3$ | 0.5 | 3.8 | 100 | 2.5–3.0 | 32 | 16 |
| $Na_2SiO_3$ | 3.0 | 3.8 | 104 | 2.5–3.0 | 35 | 35 |
| $Na_2SiO_3$ | 6.0 | 3.8 | 104 | 2.5–3.0 | 80 | 30 |

From the results reported in Tables 3A and 3B, it can be seen that the corrosion was indeed effectively reduced; and these results are seen to indicate the efficacy of the additive in reducing the corrosion of surfaces exposed to combustion gases in the cold-end of a boiler system.

EXAMPLE 4

In addition to analyzing the washings from the CERL probe for iron content, the total solids content of each sample was also determined to evaluate the fouling tendencies of the sodium metasilicate. While it is expected that an additive treatment at the cold-end of a boiler system would cause fouling, the fouling should not be so severe as to outweigh the advantages of the additive. The results of these tests are reported below in Tables 4A and 4B. In each of the preliminary tests, the results of which are reported in Table 4A, the probe was exposed to the combustion gases for a period of 0.5 hour; while in each of the confirming tests, the results of which are reported in Table 4B, the probe was exposed for a time period as indicated. The total solids are reported as parts of total solids per million parts of washing water at the probe surface temperatures indicated.

TABLE 4A

| Additive | Feed rate (pph) | Steam Load (pph × $10^3$) | % $O_2$ | Total Solids (ppm) 230° F | Total Solids (ppm) 250° F | Total Solids (ppm) 300° F |
|---|---|---|---|---|---|---|
| None | — | 90 | 2.7 | 180 | 130 | 70 |
| $Na_2SiO_3$ | 4.1 | 90 | 2.7 | 540 | 520 | 500 |
| $Na_2SiO_3$ | 4.1 | 90 | 2.7 | 600 | 570 | 540 |

TABLE 4B

| Additive | Exposure (hours) | Feedrate (pph) | Steam Load (pph × $10^3$) | % $O_2$ | Total Solids (ppm) 230° F | Total Solids (ppm) 250° F | Total Solids (ppm) 300° F |
|---|---|---|---|---|---|---|---|
| None | 0.5 | — | 100 | 2.5–3.0 | 570 | 390 | 300 |
| None | 3.0 | — | 104 | 2.5–3.0 | 1800 | 1300 | 150 |
| None | 6.0 | — | 104 | 2.6–3.1 | 3000 | 2000 | 400 |
| $Na_2SiO_3$ | 0.5 | 3.8 | 100 | 2.5–3.0 | 550 | 520 | 425 |
| $Na_2SiO_3$ | 3.0 | 3.8 | 104 | 2.5–3.0 | 2600 | 2500 | 2100 |

TABLE 4B-continued

| Additive | Exposure (hours) | Feedrate (pph) | Steam Load (pph × $10^3$) | % $O_2$ | Total Solids (ppm) 230° F | 250° F | 300° F |
|---|---|---|---|---|---|---|---|
| $Na_2SiO_3$ | 6.0 | 3.8 | 104 | 2.5–3.0 | 5200 | 5000 | 4800 |

Based upon the results reported in Tables 4A and 4B, the rate of solids deposition on the surfaces when the sodium metasilicate is used is considered to be acceptable, particularly since the deposits were easily removed.

EXAMPLE 5

In another series of tests, the CERL probe was exposed to the combustion gases for various periods of time, removed and visually inspected. The results are reported below in Table 5. The sodium metasilicate solution was further diluted with one part of water by volume.

TABLE 5

| Additive | Exposure (hours) | Appearance of Probe |
|---|---|---|
| None | 0.5 | Green coating on cold-end of probe. |
| None | 3.0 | Heavy green coating on cold-end. |
| None | 6.0 | Very heavy green coating on cold-end, which coating was difficult to wash off. |
| $Na_2SiO_3$ | 0.5 | Gritty white deposit. |
| $Na_2SiO_3$ | 3.0 | Moderate white deposit on leading and trailing edge. Deposits were removed. |
| $Na_2SiO_3$ | 6.0 | Same as 3 hours, but with more deposit. |

EXAMPLE 6

The effects of the alkanolamine alone on acid deposition rates at various surface temperatures were determined by titrating washings from a standard British Central Electricity Research Laboratories (CERL) acid deposition probe as described in Example 1.

The results of these tests are reported in Tables 6A and 6B below in terms of acid deposition rate expressed as milliliters of 0.01 N NaOH needed to titrate one fourth of the amount of acid which deposited on 18.8 square inches ($in^2$) to the phenolphthalein end point. The feedrates reported are expressed as pounds of active additive per hour, and the steam loads reported are also expressed as pounds per hour. The % $O_2$ reported is the oxygen content of the combustion gases on a % volume basis. Table 1A contains the results of the preliminary tests, and Table 1B contains the results of the confirming tests. In the preliminary tests, the acid deposition rates at 220° F. were determined, while in the confirming tests the determinations were for acid deposition at 230° F. and 250° F. In the preliminary tests, the probe was exposed to the combustion gases for thirty minutes; while in the confirming tests, the probe was exposed for the time periods indicated.

TABLE 6A

| Additive | Feedrate (pph) | Steam Load (pph × $10^3$) | % $O_2$ | Acid Deposition 220° F |
|---|---|---|---|---|
| None | — | 50 | 2.75 | 10.5 |
| None | — | 56 | 3.0 | 13.0 |
| None | — | 56 | 2.9 | 14.0 |
| Naeed | 1.2 | 53 | 3.7 | 8.0 |
| Naeea | 3.4 | 50 | 3.8 | 5.5 |
| Naeea | 3.4 | 50 | 3.8 | 4.0 |

TABLE 6B

| Additive | Exposure Time (hrs) | Feedrate (pph) | Steam Load (pph × $10^3$) | % $O_2$ | Acid Deposition 250° F | 230° F |
|---|---|---|---|---|---|---|
| None | 0.5 | — | 100 | 2.5–3.0 | 28 | 38 |
| None | 0.5 | — | 100 | 2.5–3.0 | 28 | 38 |
| None | 0.5 | — | 114 | 2.5–3.0 | 32 | 46 |
| None | 3.0 | — | 104 | 2.5–3.0 | 72 | 108 |
| Naeea | 0.5 | 2.8 | 100 | 2.5 | 9 | 12 |
| Naeea | 0.5 | 1.2 | 100 | 2.5 | 12 | 20 |
| Naeea | 3.0 | 3.05 | 104 | 2.5–3.0 | 64 | 76 |
| Naeea | 3.0 | 3.1 | 104 | 2.5–3.0 | 32 | 34 |
| Naeea | 0.5 | 4.1 | 114 | 2.5–3.0 | 10 | 10 |

EXAMPLE 7

The efficacy of the alkanolamine with respect to lowering the apparent acid dew point in the cold-end of the boiler systems was evaluated using the equipment and procedures described in Example 2. The results of these tests are reported in Tables 7A and 7B below. The feed rate of active additive and the boiler steam load are both expressed as pounds per hour, the apparent dew points are expressed as degrees Farenheit (° F.) and the rates of acid build-up (RBU) are expressed as microamperes per minute ($\mu$amp $min^{-1}$). Table 7A contains the results of the preliminary tests, and Table 7B contains the results of the confirming tests. The rate of acid build-up was determined only for a portion of the tests as indicated in the Tables and was determined at a probe surface temperature of 230° F. for both tests. A reported range for an RBU reading indicates that the reading changed during the test.

TABLE 7A

| Additive | Feedrate (pph) | Steam Load (pph × $10^3$) | % $O_2$ | Dew Point (° F) | RBU |
|---|---|---|---|---|---|
| None | — | 50 | 3.75 | 273 | 110 |
| None | — | 50 | 3.75 | 278 | — |
| None | — | 50 | 3.75 | 277 | — |
| None | — | 53 | 4.1 | 270 | 140 |
| None | — | 53 | 4.1 | 270 | — |
| Naeea | 3.4 | 50 | 3.7 | 122 | 0 |
| Naeea | 3.4 | 50 | 3.7 | 121 | — |
| Naeea | 1.2 | 53 | 4.1 | 265 | 27 |
| Naeea | 1.2 | 53 | 4.1 | 266 | — |
| Naeea | 2.4 | 53 | 3.9 | 195 | 3 |
| Naeea | 2.4 | 53 | 3.9 | 191 | — |

TABLE 7B

| Additive | Feedrate (pph) | Steam Load (pph × $10^3$) | % $O_2$ | Dew Point (° F) | RBU |
|---|---|---|---|---|---|
| None | — | 100 | 2.5–3.0 | 300 | — |
| None | — | 100 | 2.5–3.0 | — | 225 |
| None | — | 100 | 2.5–3.0 | 292 | 225 |
| None | — | 100 | 2.5–3.0 | 304 | 150 |
| None | — | 100 | 2.5–3.0 | 294 | 250 |
| None | — | 104 | 2.5–3.0 | — | 200–300 |
| None | — | 104 | 2.5–3.0 | 295 | — |
| None | — | 104 | 2.5–3.0 | 300 | 200 |
| None | — | 114 | 2.5–3.2 | 293 | 400 |
| None | — | 124 | 2.5–3.0 | 296 | — |
| None | — | 124 | 2.5–3.0 | 300 | — |
| Naeea | 1.3 | 100 | 2.7 | 280 | — |
| Naeea | 3.1 | 101 | 2.5–2.7 | — | 12 |
| Naeea | 4.5 | 104 | 2.5–3.0 | 140 | — |
| Naeea | 3.8 | 104 | 2.5–3.0 | 155 | — |
| Naeea | 3.5 | 104 | 2.5–3.0 | 260 | — |
| Naeea | 3.1 | 104 | 2.5–3.0 | 180 | 8 |
| Naeea | 4.5 | 114 | 2.5–3.0 | 150 | — |

TABLE 7B-continued

| Additive | Feed-rate (pph) | Steam Load (pph × $10^3$) | % $O_2$ | Dew Point (° F) | RBU |
|---|---|---|---|---|---|
| Naeea | 2.1 | 114 | 2.5–3.0 | 290 | — |
| Naeea | 2.5 | 114 | 2.5–3.0 | 200 | — |
| None | — | 116 | 2.5–3.0 | 300 | 420–560 |
| Naeea | 1.3 | 116 | 2.5–3.0 | 300 | 300–500 |

From Tables 7A and 7B it can be seen that the alkanolamine is efficacious both with respect to lowering the apparent acid dew point in the cold-end and with respect to decreasing the rate of acid build-up directly on surfaces in the cold-end.

EXAMPLE 8

Using a portion of the washings obtained from the CERL probe described in Examples 1 and 6 above, the efficacy of the alkanolamine with respect to protecting cold-end surfaces against corrosion was evaluated. Since the iron (Fe) content of the washings indicated the amount of corrosion of the test surfaces exposed to the combustion gases, comparisons of the iron content of the washings provided a method of evaluating the efficacy of the inventive material. The results of these comparative tests are reported below in Tables 8A and 8B, with Table 8A containing the results of the preliminary tests and Table 8B containing the results of the confirming tests. In the preliminary tests, the probe was exposed to the combustion gases for 0.5 hour, and in the confirming tests the probe was exposed for the periods indicated in Table 8B. The steam loads and active additive are expressed as pounds per hour (pph), the oxygen content of the combustion gases as percent oxygen (% $O_2$) by volume, and the iron content as parts of iron per million parts of washing liquid at the probe temperatures indicated.

TABLE 8A

| Additive | Feedrate (pph) | Steam Load (pph × $10^3$) | % $O_2$ | Iron (ppm) 230° F | Iron (ppm) 250° F |
|---|---|---|---|---|---|
| None | — | 50 | 3.7 | 3 | 2 |
| Naeea | 3.4 | 50 | 3.8 | 2 | 3 |
| Naeea | 1.2 | 53 | 4.1 | 8 | 6 |

TABLE 8B

| Additive | Ex-posure (hours) | Feed-rate (pph) | Steam Load (pph × $10^3$) | % $O_2$ | Iron (ppm) 230° F | Iron (ppm) 250° F |
|---|---|---|---|---|---|---|
| None | 0.5 | — | 100 | 2.5–3.0 | 70 | 55 |
| None | 0.5 | — | 100 | 2.5 | 60 | 25 |
| None | 3 | — | 104 | 2.5–3.0 | 130 | 70 |
| None | 6 | — | 104 | 2.6–3.1 | 400 | 200 |
| Naeea | 0.5 | 2.8 | 100 | 2.5 | 12 | 10 |
| Naeea | 0.5 | 1.2 | 100 | 2.5 | 55 | 20 |
| Naeea | 3 | 3.05 | 104 | 2.5–3.0 | 40 | 35 |
| Naeea | 3 | 3.1 | 104 | 2.5–3.0 | 10 | 10 |
| Naeea | 6 | 3.1 | 104 | 2.5–3.1 | 25 | 25 |

The results of Table 8A are considered inconclusive, at best. It is the present inventors' opinion that the rather indifferent performance of the additive probably resulted from the low corrosion rates which existed even in the absence of additive.

From the results reported in Table 8B, it can be seen that the corrosion was indeed effectively reduced; and these results are seen to indicate the efficacy of the alkanolamine in reducing the corrosion of surfaces exposed to combustion gases in the cold-end of a boiler system.

EXAMPLE 9

In addition to analyzing the washings from the CERL probe for iron content, the total solids content of each sample was also determined to evaluate the fouling tendencies of the subject treatment. The results of these tests are reported below in Tables 9A and 9B. In each of the preliminary tests, the results of which are reported in Table 9A, the probe was exposed to the combustion gases for a period of 0.5 hour; while in each of the confirming tests, the results of which are reported in Table 9B, the probe was exposed for a time period as indicated. The total solids are reported as parts of total solids per million parts of washing water at the probe surface temperatures indicated.

TABLE 9A

| Additive | Feed-rate (pph) | Steam Load (pph × $10^3$) | % $O_2$ | Total Solids (ppm) 230° F | Total Solids (ppm) 250° F | Total Solids (ppm) 300° F |
|---|---|---|---|---|---|---|
| None | — | 50 | 3.7 | 100 | 60 | 40 |
| Naeea | 3.4 | 50 | 3.8 | 170 | 80 | 180 |
| Naeea | 1.2 | 53 | 4.1 | 140 | 150 | 80 |

TABLE 9B

| Additive | Exposure Time (hours) | Feedrate (pph) | Steam Load (pph × $10^3$) | % $O_2$ | Total Solids 230° F | Total Solids 250° F | Total Solids 300° F |
|---|---|---|---|---|---|---|---|
| None | 0.5 | — | 100 | 2.5 | 460 | 250 | 75 |
| None | 3 | — | 104 | 2.5–3.0 | 1800 | 1300 | 150 |
| None | 6 | — | 104 | 2.6–3.1 | 3000 | 2000 | 400 |
| Naeea | 0.5 | 2.8 | 100 | 2.5 | 360 | 270 | 180 |
| Naeea | 0.5 | 1.2 | 100 | 2.5 | 340 | 220 | 80 |
| Naeea | 3 | 3.05 | 104 | 2.5–3.0 | 1200 | 1000 | 850 |
| Naeea | 3 | 3.1 | 104 | 2.5–3.0 | 750 | 650 | 450 |
| Naeea | 6 | 3.1 | 104 | 2.5–3.1 | 2600 | 2400 | 1400 |

Based on the results reported above in Tables 9A and 9B, the rate of solids deposition on the surfaces when the additive is used is considered to be exceptional.

EXAMPLE 10

In another series of tests, the CERL probe was exposed to the combustion gases for various periods of time, removed and visually inspected. The results are reported below in Table 10.

TABLE 10

| Additive | Exposure Time (hours) | Appearance of Probe |
|---|---|---|
| None | 0.5 | Green coating on cold-end of probe. |
| None | 3 | Heavy green coating on cold-end. |
| None | 6 | Very heavy green coating on cold-end, which coating was difficult to wash off. |
| Naeea eea | 0.5 | Clean, glossy. |
| Naeea | 3 | No apparent build-up. Slightly tacky, Easily washed |
| Naeea | 6 | Shiny, Soot on leading |

TABLE 10-continued

| Additive | Exposure Time (hours) | Appearance of Probe |
|---|---|---|
| | | edge. Sticky at cold-end. Easily washed |

Having thus established the efficacy of the sodium metasilicate and the alkanolamine alone, as cold-end additives, the present inventors evaluated the efficacy of a combined treatment. Indeed, it is considered highly desirable to be able to combine the individual additives on an optimized cost basis. Furthermore, depending on the particular problem to be treated, it may be desirable to combine the additives to take advantage of the respective strengths of each and/or to possibly supplement the relative weaknesses of each.

EXAMPLE 11

Using the same test procedures as described in Examples 1 and 6 above, with respect to the confirming tests and using the additives described therein but in combination, the effect of the combined treatment on acid deposition was evaluated. The results of this test are reported below in Table 11 in terms of acid deposition rate expressed as milliliters of 0.01N NaOH needed to titrate one-fourth of the amount of acid which deposited on 18.8 square inches ($in^2$) to the phenolphthalein end point. The feedrates reported are expressed as pounds of active additive per hour, and the steam loads reported are also expressed as pounds per hour. The % $O_2$ reported is the oxygen content of the combustion gases on a % volume basis.

TABLE 11

| Additive | Exposure (hrs) | Feedrate (ppm) | Steam Load (pph × $10^3$) | % $O_2$ | Acid Deposition 230° F | Acid Deposition 250° F |
|---|---|---|---|---|---|---|
| None | 0.5 | — | 100 | 2.5–3.0 | 38 | 28 |
| None | 0.5 | — | 100 | 2.5–3.0 | 38 | 28 |
| None | 0.5 | — | 100 | 2.5–3.0 | 38 | 28 |
| Naeea + $Na_2SiO_3$ | 0.5 | 0.8 + 3.5 | 100 | 2.5–3.0 | 13 | 12 |

EXAMPLE 12

Using the same test procedures as described above in Examples 2 and 7, with respect to the confirming tests, and using the additives described therein but in combination, the efficacy of the combined treatment with respect to lowering the apparent acid dew point and rate of acid build-up in the cold-end of a boiler system was evaluated. The results are reported in Table 12 below. The feedrate of active additive and the boiler steam load are both expressed as pounds per hour, the apparent dew points are expressed as degrees Farenheit (° F.), and the rates of acid build-up (RBU) are expressed as micro-amperes per minute ($\mu$amp $min^{-1}$).

TABLE 12

| Additive | Feedrate (pph) | Steam Load (pph × $10^3$) | % $O_2$ | Dew Point (° F) | RBU |
|---|---|---|---|---|---|
| None | — | 100 | 2.5–3.0 | — | 225 |
| None | — | 100 | 2.5–3.0 | 292 | 225 |
| None | — | 100 | 2.5–3.0 | 304 | 150 |
| None | — | 100 | 2.5–3.0 | 294 | 250 |
| Naeea + $Na_2SiO_3$ | 0.8 + 3.5 | 100 | 2.5–3.0 | 150 | 0 |

EXAMPLE 13

Using the same test procedures as described above in Examples 3 (with respect to confirming tests) and 8 and using the additives described therein but in combination, the efficacy of the combined treatment with respect to protecting cold-end surfaces against corrosion was evaluated. The results of these tests ar reported below in Table 13. The steam loads and active additive are expressed as pounds per hour (pph), the oxygen content of the combustion gases as percent oxygen (% $O_2$) by volume, and the iron content as parts of iron per million parts of washing liquid at the probe temperatures indicated.

TABLE 13

| Additive | Exposure (hrs) | Feedrate (pph) | Steam Load (pph × $10^3$) | % $O_2$ | Iron (ppm) 230° F | Iron (ppm) 250° F |
|---|---|---|---|---|---|---|
| None | 0.5 | — | 100 | 2.5–3.0 | 70 | 55 |
| None | 0.5 | — | 100 | 2.5–3.0 | 80 | 55 |
| None | 0.5 | — | 100 | 2.5–3.0 | 90 | 60 |
| None | 0.5 | — | 100 | 2.5–3.0 | 90 | 60 |
| Naeea + $Na_2SiO_3$ | 0.5 | 0.8 + 3.5 | 100 | 2.5–3.0 | 20 | 12 |

EXAMPLE 14

In addition to analyzing the washings from the CERL probe for iron content as reported in Example 13, the total solids content of each sample was also determined to evaluate the fouling tendencies of the combined treatment. The results are reported below in Table 14. The total solids ae expressed as parts of total solids per million parts of washing water at the probe surface temperatures indicated.

TABLE 14

| Additive | Exposure (hrs) | Feedrate (pph) | Steam Load (pph × $10^3$) | % $O_2$ | Total Solids (ppm) 230° F | Total Solids (ppm) 250° F | Total Solids (ppm) 300° F |
|---|---|---|---|---|---|---|---|
| None | 0.5 | — | 100 | 2.5–3.0 | 500 | 380 | 200 |
| None | 0.5 | — | 100 | 2.5–3.0 | 520 | 320 | 110 |
| None | 0.5 | — | 100 | 2.5–3.0 | 520 | 390 | 100 |
| None | 0.5 | — | 100 | 2.5–3.0 | 570 | 390 | 300 |
| Naeea + $Na_2SiO_3$ | 0.5 | 0.8 + 3.5 | 100 | 2.5–3.0 | 410 | 420 | 450 |

Based on the results reported above in Tables 1–10 which are seen to demonstrate the efficacy of the sodium metasilicate and the alkanolamine, individually, as cold-end additives, and the results reported in Tables 11–14, a treatment composition comprising an aqueous solution of sodium metasilicate and alkanolamine is considered to have efficacy as a cold-end additive.

Having thus described the invention, what is claimed is:

1. A method of reducing the amount of sulfur trioxide condensation on, and therefore the amount of sulfuric acid corrosion of, metal parts at the cold-end of a combustion system in contact with combustion gases derived from the combustion of sulfur-containing fuel, which combustion gases flow along a path at the cold-end of the combustion system from a first zone of relative turbulence to a second zone at which the turbulence subsides, said method comprising:

adding to the combustion gases at the cold-end of the combustion system and at said zone of turbulence an effective amount for the purpose of an aqueous solution of sodium metasilicate and N-aminoethyl ethnolamine such that the additive will travel along with said combustion gases as solids, vapor, and/or liquid droplets from said zone of turbulence to said second zone and deposit on surfaces of said metal parts.

2. The method of claim 1, wherein the additive is sprayed into the combustion gases.

3. The method of claim 1, wherein the combustion system is a steam generating system, and wherein the fuel is sulfur-containing oil.

4. The method of claim 1, wherein the sodium metasilicate is added in an amount of from about 0.15 to about 0.9 pound per pound of sulfur trioxide generated upon combustion of the fuel, and wherein the alkanolamine is added in an amount of from about 0.1 to about 0.85 pound per pound of sulfur trioxide generated, with the proviso that the total treatment level does not exceed about 1.0 pound per pound of sulfur trioxide generated.

5. The method of claim 4, wherein the sodium metasilicate is added in an amount of from about 0.25 to about 0.75 pound per pound of sulfur trioxide generated, and wherein the alkanolamine is added in an amount of from about 0.25 to about 0.33 pound of alkanolamine per pound or sulfur trioxide generated, with the proviso that the total treatment level does not exceed about 1.0 pound per pound of sulfur trioxide generated.

6. The method of claim 1, wherein at the point of addition the combustion gases have a temperature of from about 405° F. to about 675° F.

7. The method of claim 6, wherein at the point of addition the combustion gases have a temperature of from about 405° F. to about 650° F.

8. The method of claim 1, wherein the temperature of the combustion gases at the time of addition is from about 250° F. to about 675° F.

9. The method of claim 8, wherein the temperature of the combustion gases at the time of addition is from about 350° F. to about 650° F.

10. The method of claim 8, wherein at the point of addition the combustion gases have a temperature of from about 405° F. to about 675° F.

11. The method of claim 1, wherein the additive is fed in droplet form to the combustion gases.

12. The method of claim 11, wherein the additive is sprayed into the combustion gases.

13. The method of claim 11, wherein the droplets have a size of less than about 360 microns.

14. The method of claim 13, wherein the droplets have a size of less than about 260 microns.

* * * * *